US009587209B2

(12) United States Patent
De Meirleir et al.

(10) Patent No.: US 9,587,209 B2
(45) Date of Patent: Mar. 7, 2017

(54) STRUCTURING WITH THREADS OF NON-POLYMERIC, CRYSTALLINE, HYDROXYL-CONTAINING STRUCTURING AGENTS

(71) Applicant: The Procter & Gamble Company, Cincinnati, OH (US)

(72) Inventors: Niels De Meirleir, Sint-Stevens-Woluwe (BE); Walter August Maria Broeckx, Berlare (BE); Linda Pellens, Erps-Kwerps (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/102,651

(22) Filed: Dec. 11, 2013

(65) Prior Publication Data

US 2014/0162930 A1 Jun. 12, 2014

(30) Foreign Application Priority Data

Dec. 12, 2012 (EP) ..... 12196750

(51) Int. Cl.

| | |
|---|---|
| ***C11D 3/20*** | (2006.01) |
| ***C11D 17/00*** | (2006.01) |
| ***C11D 11/00*** | (2006.01) |
| ***C11D 17/04*** | (2006.01) |

(52) U.S. Cl.

CPC ..... *C11D 17/0026* (2013.01); *C11D 3/2093* (2013.01); *C11D 11/0064* (2013.01); *C11D 17/043* (2013.01)

(58) Field of Classification Search

None

See application file for complete search history.

(56) References Cited

U.S. PATENT DOCUMENTS

| | | | | |
|---|---|---|---|---|
| 7,294,611 | B2 | 11/2007 | Metrot et al. | |
| 8,940,677 | B2 | 1/2015 | Boutique et al. | |
| 2002/0103094 | A1* | 8/2002 | Masschelein et al. | 510/276 |
| 2002/0160928 | A1* | 10/2002 | Smerznak et al. | 510/405 |
| 2004/0058845 | A1 | 3/2004 | Metrot et al. | |
| 2004/0200005 | A1* | 10/2004 | Smerznak et al. | 8/115.51 |
| 2005/0043200 | A1* | 2/2005 | Barry et al. | 510/421 |
| 2006/0189507 | A1* | 8/2006 | Metrot et al. | 510/515 |
| 2011/0065625 | A1 | 3/2011 | Boutique et al. | |
| 2011/0136721 | A1* | 6/2011 | Erbezci et al. | 510/513 |

FOREIGN PATENT DOCUMENTS

| | | | |
|---|---|---|---|
| EP | 2 495 300 | A1 | 5/2012 |
| WO | WO 2010/034736 | A1 | 4/2010 |

OTHER PUBLICATIONS

EP Search Report for EP Application No. 12196750.9, dated May 14, 2013, containing 4 pages.

PCT Search Report for International application No. PCT/US2013/074044, 4 pages, dated Jun. 16, 2015.

* cited by examiner

*Primary Examiner* — Lorna Douyon

(74) *Attorney, Agent, or Firm* — Gregory S. Darley-Emerson; Leonard W. Lewis; Steven W. Miller

(57) ABSTRACT

The need for a structurant premix that provides improved structuring of liquid compositions, while exhibiting less performance variation due to process variation or variation in ingredient levels, that is also particularly suitable for low water liquid compositions, is met through the use of an aqueous structuring premix comprising long threads of non-polymeric, crystalline, hydroxyl-containing structuring agent.

20 Claims, No Drawings

STRUCTURING WITH THREADS OF NON-POLYMERIC, CRYSTALLINE, HYDROXYL-CONTAINING STRUCTURING AGENTS

FIELD OF THE INVENTION

Improved structuring premixes, comprising long threads, can be made from emulsions of non-polymeric, crystalline, hydroxyl-containing structuring agent, using a multistep process which comprises a step of raising the temperature to a range where the emulsion droplets elongate.

BACKGROUND OF THE INVENTION

Aqueous structurant premixes comprising a non-polymeric, crystalline, hydroxyl-containing structuring agent, such as hydrogenated castor oil, have been used to structure and thicken liquid compositions. While the non-polymeric, crystalline, hydroxyl-containing structuring agent can be melted and directly dispersed into a liquid composition, the structuring agent is usually first formed into a premix in order to both improve processibility, and to improve structuring efficacy. Hence, the molten structuring agent is generally first emulsified in water, and then crystallised to form an aqueous structuring premix. The resultant aqueous structuring premix is then added to a liquid composition (see for example, WO2011031940).

In recent years, liquid compositions, for use around the household, have increased in complexity, comprising a wide variety of polymers, and particulates, such as deposition aids, soil release polymers, microcapsules, perfume droplets and other oils, in addition to typical ingredients such as surfactants. Such additives provide a variety of benefits, such as better stain removal and stain repellence, care benefits such as fabric softening or skin protection, and improved aesthetics, including longer lasting freshness. The result is a liquid composition with a complex balance of hydrophilic and hydrophobic ingredients. Changes in formulation, and even level changes arising from process variation, result in changes in the hydrophilic-hydrophobic balance, as well as changes in the ionic strength.

In order to account for process variations, and other variations in ingredient levels, a higher level of structuring premix must be added, in order to ensure the desired minimum viscosity and level of structuring. This is particularly of concern for liquid compositions comprising suspended particulates or droplets, since insufficient low shear viscosity quickly results in settling or rising of the particulates or droplets, depending on the density difference. In addition, since such structuring premixes are aqueous, they result in additional water being introduced into the liquid composition. This is of particular concern for low water liquid compositions, such as those that are to be encapsulated in a water-soluble film to form unit-does articles.

Therefore, a need remains for an aqueous structuring premix, comprising a non-polymeric, crystalline, hydroxyl-containing structuring agent, having improved structuring efficacy, particularly at low shear rates. By improving the structuring efficacy, less of the structuring premix needs to be added, to ensure the desired minimum viscosity and level of structuring. Having a more efficacious aqueous structuring premix also means that less of the structuring premix needs to be added into an essentially non-aqueous liquid composition, in order to achieve the desired level of structuring. Hence, less water is introduced with the aqueous structuring premix, into such non-aqueous liquid compositions.

SUMMARY OF THE INVENTION

The present invention relates to an aqueous structuring premix comprising a non-polymeric, crystalline, hydroxyl-containing structuring agent in the form of threads, wherein at least 15% by number of the threads have a length greater than 10 microns.

The present invention further relates to a process for making such structuring, comprising the steps of: making an emulsion comprising hydrogenated castor oil in water at a first temperature of from 80° C. to 98° C.; cooling the emulsion to a second temperature of from 30° C. to 55° C.; maintaining the emulsion at the second temperature for at least 2 minutes; increasing the temperature of the emulsion to a third temperature of from 60° C. to 75° C.; and maintaining the emulsion at the third temperature for at least 2 minutes.

The present invention further relates to a liquid composition comprising the aqueous structuring premix.

The present invention further relates to a unit dose article, comprising the aforementioned liquid composition, wherein the liquid composition comprises less than 20% by weight of water, encapsulated in a water-soluble film.

The present invention further relates to the use of the aforementioned structuring premix for structuring liquid compositions.

DETAILED DESCRIPTION OF THE INVENTION

Structuring premixes, comprising a non-polymeric, crystalline, hydroxyl-containing structuring agent, structure liquid compositions, by forming a structuring network in the liquid composition. Such aqueous structuring premixes have previously been formed by emulsifying the structuring agent at a temperature at or above the melt point of the structuring agent, and then reducing the temperature to crystallise the structuring agent. Without wishing to be bound by theory, it is believed that the small crystals of the structuring agent, formed by such processes, are able to coalesce to form a structuring network. It is believed that this network formation is influenced by variations in the makeup of the liquid composition, which alter either the hydrophobic-hydrophilic balance of the composition, or its ionic strength. In order to compensate for variations in structuring efficacy, arising from level variations of certain ingredients, more structurant has to be added to ensure the desired minimum viscosity, and level of structuring.

It has been surprisingly discovered, that an additional process step of maintaining the premix at an elevated temperature results in the crystals growing to form long threads. The resultant structuring premix, comprising these long threads, is more effective at increasing the viscosity, particularly at low shear rates. Threads are elongated structures, comprising the non-polymeric, crystalline, hydroxyl-containing structuring agent, and preferably having an aspect ratio, the ratio of axial length to width, as measured via atomic force microscopy, of greater than 10:1. It is also believed that when the structuring premix is added to a liquid composition, the long threads are more readily able to form a structuring network, and are less influenced by variations in the makeup of the liquid composition. As such, the structuring premixes of the present invention, comprising the longer threads, are particularly useful for structuring liquid compositions, as they retain a higher viscosity level after blending with the liquid composition.

Since the resultant structuring premix provides a higher low shear viscosity, the structuring premix is also more effective at suspending particulates or droplets in liquid compositions, including solid particulates such as perfume microcapsules, and the like, and liquid droplets such as perfume droplets, other oils, and the like.

The structuring premix of the present invention is more efficient at structuring liquid compositions. Hence, less structuring premix needs to be added to deliver the desired level of structuring. Therefore, less water is introduced by the structuring premix, into the liquid composition. As such, structuring premix of the present invention is particularly preferred for low water liquid compositions, such as those intended to be encapsulated in water-soluble films to form unit dose articles.

As defined herein, "essentially free of" a component means that the component is present at a level of less that 15%, preferably less 10%, more preferably less than 5%, even more preferably less than 2% by weight of the respective premix or composition. Most preferably, "essentially free of" a component means that no amount of that component is present in the respective premix, or composition.

As defined herein, "stable" means that no visible phase separation is observed for a premix kept at 25° C. for a period of at least two weeks, preferably at least four weeks, more preferably at least a month or even more preferably at least four months, as measured using the Floc Formation Test, described in USPA 2008/0263780 A1.

All percentages, ratios and proportions used herein are by weight percent of the respective premix or composition, unless otherwise specified. All average values are calculated "by weight" of the respective premix, composition, or components thereof, unless otherwise expressly indicated.

Unless otherwise noted, all component, premix, or composition levels are in reference to the active portion of that component, premix, or composition, and are exclusive of impurities, for example, residual solvents or by-products, which may be present in commercially available sources of such components or compositions.

All measurements are performed at 25° C. unless otherwise specified.

The Aqueous Structuring Premix:

The aqueous structuring premix of the present invention comprises water, which forms the balance of the structuring premix, after the weight percentage of all of the other ingredients are taken into account. Water is preferably present at a level of from 45% to 97%, more preferably from 55% to 93%, even more preferably from 65% to 87% by weight of the aqueous structuring premix.

The non-polymeric crystalline, hydroxyl functional structuring agent is emulsified into the water. Non-polymeric crystalline, hydroxyl functional structuring agents comprise a crystallisable glyceride. Preferably, the non-polymeric, crystalline, hydroxyl-containing structuring agent comprises, or even consists of, hydrogenated castor oil (commonly abbreviated to "HCO") or derivatives thereof.

The aqueous structuring premix of the present invention comprises a non-polymeric, crystalline, hydroxyl-containing structuring agent in the form of threads. The non-polymeric, crystalline, hydroxyl-containing structuring agent is preferably present at a level of from 2% to 10%, more preferably from 3% to 8%, even more preferably from 4% to 6% by weight of the aqueous structuring premix.

The threads preferably have a width of from 10 to 50 nm. At least 15% by number of the threads have a length greater than 10 microns. Preferably, at least 15% by number of the threads have a length greater than 10 microns, and less than 25 microns. It has been found that such long threads result in improved structuring. When the percentage of such long threads is increased, the structuring efficacy of the aqueous structuring premix also increases. Preferably at least 25%, preferably 35% by number of the threads have a length greater than 10 microns. Preferably, at least 25%, preferably 35% by number of the threads have a length greater than 10 microns, and less than 25 microns. Preferably at least 10%, preferably 15%, more preferably 20% by number of the threads have a length greater than 14 microns. Preferably at least 10%, preferably 15%, more preferably 20% by number of the threads have a length greater than 14 microns, and less than 25 microns. The longer the threads are more effective at structuring, and providing viscosity.

As mentioned earlier, the non-polymeric, crystalline, hydroxyl-containing structuring agent is preferably hydrogenated castor oil. Castor oil is a triglyceride vegetable oil, comprising predominately ricinoleic acid, but also oleic acid and linoleic acids. When hydrogenated, it becomes castor wax, otherwise known as hydrogenated castor oil. The hydrogenated castor oil may comprise at least 85% by weight of the castor oil of ricinoleic acid. Preferably, the hydrogenated castor oil comprises glyceryl tris-12-hydroxystearate (CAS 139-44-6). In a preferred embodiment, the hydrogenated castor oil comprises at least 85%, more preferably at least 95% by weight of the hydrogenated castor oil of glyceryl tris-12-hydroxystearate. However, the hydrogenated castor oil composition can also comprise other saturated, or unsaturated linear or branched esters. In a preferred embodiment, the hydrogenated castor oil has a melting point in the range of from 45° C. to 95° C., as measured using ASTM D3418 or ISO 11357. The hydrogenated castor oil may have a low residual unsaturation and will generally not be ethoxylated, as ethoxylation tends to reduce the melting point temperature to an undesirable extent. By low residual unsaturation, we herein mean an iodine value of 20 of less, preferably 10 or less, more preferably 3 or less. Those skilled in the art would know how to measure the iodine value using commonly known techniques.

The aqueous structuring premix of the present invention preferably comprises a surfactant, added as an emulsifying agent in order to improve emulsification of the non-polymeric, crystalline, hydroxyl-containing structuring agent, and to stabilize the resultant droplets. When added, the surfactant is preferably added at a concentration above the critical micelle concentration (c.m.c) of the surfactant. When the non-polymeric, crystalline, hydroxyl-containing structuring agent is emulsified into an aqueous phase containing these micelles, a portion of the non-polymeric, crystalline, hydroxyl-containing structuring agent is transferred to the micelles, to form droplets that are stabilised by the micelles. The surfactant may be present in the aqueous structuring premix at a level of from 1% to 45%, preferably from 4% to 37%, more preferably from 9% to 29% of the aqueous structuring premix. The weight percentage of surfactant is measured, based on the weight percentage of the surfactant anion. That is, excluding the counterion. When using more than 25% by weight of the structuring premix of an anionic surfactant, it is preferred to thin the surfactant using an organic solvent, in addition to water.

Detersive surfactants are preferred, i.e. a surfactant that provides detersive effect on hard surfaces or fabrics. For example, a detersive surfactant may provide greasy stain or soil/clay stain removal from treated surfaces or substrates. For instance, the detersive surfactant may provide fabric cleaning benefits during a washing cycle. The surfactant can be selected from the group comprising anionic, non-ionic, cationic and zwitterionic surfactants. Although any suitable surfactant can be used, an anionic surfactant is preferred. Preferably, the anionic surfactant is selected from the group consisting of: alkyl sulphonate, alkylbenzene sulphonate, alkyl sulphate, alkyl alkoxylated sulphate and mixtures thereof. Depending on the pH, either the acid form or salt form of the anionic surfactant can be used. However, while the acid form of the anionic surfactant can be used, the anionic surfactant is preferably neutralized, before the addition of the non-polymeric, crystalline, hydroxyl-containing structuring agent.

Preferred sulphonate detersive surfactants include alkyl benzene sulphonate, preferably $C_{10-13}$ alkyl benzene sulphonate. Suitable alkyl benzene sulphonate (LAS) is preferably obtained by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A preferred anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{12}$ alkyl sulphate.

Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 7, more preferably from 0.5 to 5 and most preferably from 0.5 to 3.

The alkyl sulphate, alkyl alkoxylated sulphate and alkyl benzene sulphonates may be linear or branched, substituted or un-substituted.

The aqueous structuring premix may contain additional surfactant in addition to anionic surfactants. In particular, the aqueous structuring premix may comprise additional surfactant selected from: nonionic surfactant; cationic surfactant; amphoteric surfactant; zwitterionic surfactant; and mixtures thereof.

The aqueous structuring premix may further comprise a pH adjusting agent. Any known pH-adjusting agents can be used, including alkalinity sources as well as acidifying agents of either inorganic type and organic type, depending on the desired pH.

The pH-adjusting agent is typically present at concentrations from 0.2% to 20%, preferably from 0.25% to 10%, more preferably from 0.3% to 5.0% by weight of the aqueous structuring premix.

Inorganic alkalinity sources include but are not limited to, water-soluble alkali metal hydroxides, oxides, carbonates, bicarbonates, borates, silicates, metasilicates, and mixtures thereof; water-soluble alkali earth metal hydroxides, oxides, carbonates, bicarbonates, borates, silicates, metasilicates, and mixtures thereof; water-soluble boron group metal hydroxides, oxides, carbonates, bicarbonates, borates, silicates, metasilicates, and mixtures thereof; and mixtures thereof. Preferred inorganic alkalinity sources are sodium hydroxide, and potassium hydroxide and mixtures thereof, most preferably inorganic alkalinity source is sodium hydroxide. Although not preferred for ecological reasons, water-soluble phosphate salts may be utilized as alkalinity sources, including pyrophosphates, orthophosphates, polyphosphates, phosphonates, and mixtures thereof.

Organic alkalinity sources include but are not limited to, primary, secondary, tertiary amines, and mixtures thereof. Other organic alkalinity sources are alkanolamine or mixture of alkanolamines. Suitable alkanolamines may be selected from the lower alkanol mono-, di-, and trialkanolamines, such as monoethanolamine; diethanolamine or triethanolamine. Higher alkanolamines have higher molecular weight and may be less mass efficient for the present purposes. Mono- and di-alkanolamines are preferred for mass efficiency reasons. Monoethanolamine is particularly preferred, however an additional alkanolamine, such as triethanolamine, can be useful in certain embodiments as a buffer. Most preferred alkanolamine used herein is monoethanol amine.

Inorganic acidifying agents include but are not limited to, HF, HCl, HBr, HI, boric acid, phosphoric acid, phosphonic acid, sulphuric acid, sulphonic acid, and mixtures thereof. Preferred inorganic acidifying agent is boric acid.

Organic acidifying agents include but are not limited to, substituted and substituted, branched, linear and/or cyclic $C_1$ to $C_{30}$ carboxyl acids, and mixtures thereof.

The aqueous structuring premix may optionally comprise a pH buffer. In some embodiments, the pH is maintained within the pH range of from 5 to 11, or from 6 to 9.5, or from 7 to 9. Without wishing to be bound by theory, it is believed that the buffer stabilizes the pH of the aqueous structuring premix, thereby limiting any potential hydrolysis of the HCO structurant. However, buffer-free embodiments can be contemplated and when HCO hydrolyses, some 12-hydroxystearate may be formed, which is also capable of structuring, though to a lesser extent than HCO. In certain preferred buffer-containing embodiments, the pH buffer does not introduce monovalent inorganic cations, such as sodium, into the structuring premix. The preferred buffer is the monethanolamine salt of boric acid. However embodiments are also contemplated in which the buffer is free from any deliberately added sodium, boron or phosphorus. In some embodiments, MEA neutralized boric acid may be present at a level of from 0% to 5%, from 0.5% to 3%, or from 0.75% to 1% by weight of the aqueous structuring premix.

As already noted, alkanolamines such as triethanolamine and/or other amines can be used as buffers, provided that alkanolamine is first added in an amount sufficient for the primary structurant emulsifying purpose of neutralizing the acid form of anionic surfactants, or the anionic surfactant has previously been neutralized by another means.

The aqueous structuring premix may further comprise a non-aminofunctional organic solvent. Non-aminofunctional organic solvents are organic solvents which contain no amino functional groups. Preferred non-aminofunctional organic solvents include monohydric alcohols, dihydric alcohols, polyhydric alcohols, glycerol, glycols including polyalkylene glycols such as polyethylene glycol, and mixtures thereof. More preferred non-aminofunctional organic solvents include monohydric alcohols, dihydric alcohols, polyhydric alcohols, glycerol, and mixtures thereof. Highly preferred are mixtures of non-aminofunctional organic solvents, especially mixtures of two or more of the following: lower aliphatic alcohols such as ethanol, propanol, butanol, isopropanol; diols such as 1,2-propanediol or 1,3-propanediol; and glycerol. Also preferred are mixtures of propanediol and diethylene glycol. Such mixtures preferably contain no methanol or ethanol.

Preferable non-aminofunctional organic solvents are liquid at ambient temperature and pressure (i.e. 21° C. and 1 atmosphere), and comprise carbon, hydrogen and oxygen. Non-aminofunctional organic solvents may be present when preparing the structurant premix, or added directly to the liquid composition.

The aqueous structuring premix may also comprise a preservative or biocide, especially when it is intended to store the premix before use.

Liquid Compositions Comprising the Aqueous Structuring Premix:

The aqueous structuring premix, of the present invention, is useful for structuring liquid compositions. Hence, a liquid composition can comprise the aqueous structuring premix of the present invention. The liquid compositions of the present invention typically comprise from 0.01 wt % to 2 wt %, preferably from 0.03 wt % to 1 wt %, more preferably from 0.05 wt % to 0.5 wt % of the non-polymeric, crystalline, hydroxyl-containing structuring agent, introduced via the aqueous structuring premix.

Suitable liquid compositions include: products for treating fabrics, including laundry detergent compositions and rinse additives; hard surface cleaners including dishwashing compositions, floor cleaners, and toilet bowl cleaners. The aqueous structuring premix of the present invention is particularly suited for liquid detergent compositions. Such liquid detergent compositions comprise sufficient detersive surfactant, so as to provide a noticeable cleaning benefit. Most preferred are liquid laundry detergent compositions, which are capable of cleaning a fabric, such as in a domestic washing machine.

As used herein, "liquid composition" refers to any composition comprising a liquid capable of wetting and treating a substrate, such as fabric or hard surface. Liquid compositions are more readily dispersible, and can more uniformly coat the surface to be treated, without the need to first dissolve the composition, as is the case with solid compositions. Liquid compositions can flow at 25° C., and include compositions that have an almost water like viscosity, but also include "gel" compositions that flow slowly and hold their shape for several seconds or even minutes.

A suitable liquid composition can include solids or gases in suitably subdivided form, but the overall composition excludes product forms which are non-liquid overall, such as tablets or granules. The liquid compositions preferably have densities in the range from of 0.9 to 1.3 grams per cubic centimeter, more preferably from 1.00 to 1.10 grams per cubic centimeter, excluding any solid additives but including any bubbles, if present.

Preferably, the liquid composition comprises from 1% to 95% by weight of water, non-aminofunctional organic solvent, and mixtures thereof. For concentrated liquid compositions, the composition preferably comprises from 15% to 70%, more preferably from 20% to 50%, most preferably from 25% to 45% by weight of water, non-aminofunctional organic solvent, and mixtures thereof. Alternatively, the liquid composition may be a low water liquid composition. Such low water liquid compositions can comprise less than 20%, preferably less than 15%, more preferably less than 10% by weight of water.

The liquid composition of the present invention may comprise from 2% to 40%, more preferably from 5% to 25% by weight of a non-aminofunctional organic solvent.

The liquid composition can also be encapsulated in a water soluble film, to form a unit dose article. Such unit dose articles comprise a liquid composition of the present invention, wherein the liquid composition is a low water liquid composition, and the liquid composition is enclosed in a water-soluble or dispersible film.

The unit dose article may comprise one compartment, formed by the water-soluble film which fully encloses at least one inner volume, the inner volume comprising the low water liquid composition. The unit dose article may optionally comprise additional compartments comprising further low water liquid compositions, or solid compositions. A multi-compartment unit dose form may be desirable for such reasons as: separating chemically incompatible ingredients; or where it is desirable for a portion of the ingredients to be released into the wash earlier or later. The unit-dose articles can be formed using any means known in the art.

Unit dose articles, wherein the low water liquid composition is a liquid laundry detergent composition are particularly preferred.

Suitable water soluble pouch materials include polymers, copolymers or derivatives thereof. Preferred polymers, copolymers or derivatives thereof are selected from the group consisting of: polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof.

As mentioned earlier, the liquid composition of the present invention can be a liquid detergent composition, preferably a liquid laundry detergent composition. Liquid detergent compositions comprise a surfactant, to provide a detergency benefit. The liquid detergent compositions of the present invention may comprise from 1% to 70%, preferably from 5% to 60%, more preferably from 10% to 50%, most preferably from 15% to 45% by weight of a detersive surfactant. Suitable detersive surfactants can be selected from the group consisting of: anionic, nonionic surfactants and mixtures thereof. The preferred weight ratio of anionic to nonionic surfactant is from 100:0 (i.e. no nonionic surfactant) to 5:95, more preferably from 99:1 to 1:4, most preferably from 5:1 to 1.5:1.

The liquid detergent compositions of the present invention preferably comprise from 1 to 50%, more preferably from 5 to 40%, most preferably from 10 to 30% by weight of one or more anionic surfactants. Preferred anionic surfactant are selected from the group consisting of: C11-C18 alkyl benzene sulphonates, C10-C20 branched-chain and random alkyl sulphates, C10-C18 alkyl ethoxy sulphates, mid-chain branched alkyl sulphates, mid-chain branched alkyl alkoxy sulphates, C10-C18 alkyl alkoxy carboxylates comprising 1-5 ethoxy units, modified alkylbenzene sulphonate, C12-C20 methyl ester sulphonate, C10-C18 alpha-olefin sulphonate, C6-C20 sulphosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. The detergent compositions preferably comprise at least one sulphonic acid surfactant, such as a linear alkyl benzene sulphonic acid, or the water-soluble salt form of the acid.

The detergent compositions of the present invention preferably comprise up to 30%, more preferably from 1 to 15%, most preferably from 2 to 10% by weight of one or more nonionic surfactants. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

The liquid detergent composition may also include conventional detergent ingredients selected from the group consisting of: additional surfactants selected from amphoteric, zwitterionic, cationic surfactant, and mixtures thereof; enzymes; enzyme stabilizers; amphiphilic alkoxylated grease cleaning polymers; clay soil cleaning polymers; soil release polymers; soil suspending polymers; bleaching systems; optical brighteners; hueing dyes; particulates; perfume and other odour control agents, including perfume delivery systems; hydrotropes; suds suppressors; fabric care perfumes; pH adjusting agents; dye transfer inhibiting agents; preservatives; non-fabric substantive dyes; and mixtures thereof.

The aqueous structuring premixes of the present invention are particularly effective at stabilizing particulates since the aqueous structuring premix, comprising longer threads, provides improved low shear viscosity. As such, the aqueous structuring premixes of the present invention are particularly suited for stabilizing liquid compositions which further comprise particulates. Suitable particulates can be selected from the group consisting of microcapsules, oils, and mixtures thereof. Particularly preferred oils are perfumes, which provide an odour benefit to the liquid composition, or to substrates treated with the liquid composition. When added, such perfumes are added at a level of from 0.1% to 5%, more preferably from 0.3% to 3%, even more preferably from 0.6% to 2% by weight of the liquid composition.

Microcapsules are typically added to liquid compositions, in order to provide a long lasting in-use benefit to the treated substrate. Microcapsules can be added at a level of from 0.01% to 10%, more preferably from 0.1% to 2%, even more preferably from 0.15% to 0.75% of the encapsulated active, by weight of the liquid composition. In a preferred embodiment, the microcapsules are perfume microcapsules, in which the encapsulated active is a perfume. Such perfume microcapsules release the encapsulated perfume upon breakage, for instance, when the treated substrate is rubbed.

The microcapsules typically comprise a microcapsule core and a microcapsule wall that surrounds the microcapsule core. The microcapsule wall is typically formed by cross-linking formaldehyde with at least one other monomer. The term "microcapsule" is used herein in the broadest sense to include a core that is encapsulated by the microcapsule wall. In turn, the core comprises a benefit agent, such as a perfume.

The microcapsule core may optionally comprise a diluent. Diluents are material used to dilute the benefit agent that is to be encapsulated, and are hence preferably inert. That is, the diluent does not react with the benefit agent during making or use. Preferred diluents may be selected from the group consisting of: isopropylmyristate, propylene glycol, poly(ethylene glycol), or mixtures thereof.

Microcapsules, and methods of making them are disclosed in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627.

Encapsulation techniques are disclosed in MICROENCAPSULATION: Methods and Industrial Applications, Edited by Benita and Simon (Marcel Dekker, Inc., 1996). Formaldehyde based resins such as melamine-formaldehyde or urea-formaldehyde resins are especially attractive for perfume encapsulation due to their wide availability and reasonable cost.

The microcapsules preferably have a size of from 1 micron to 75 microns, more preferably from 5 microns to 30 microns. The microcapsule walls preferably have a thickness of from 0.05 microns to 10 microns, more preferably from 0.05 microns to 1 micron. Typically, the microcapsule core comprises from 50% to 95% by weight of the benefit agent.

Process for Making the Structuring Premix:

The aqueous structuring premix of the present invention can be made using a process for making a structuring premix according to any preceding claim, comprising the steps of: making an emulsion comprising a non-polymeric, crystalline, hydroxyl-containing structuring agent in water at a first temperature of from 80° C. to 98° C.; cooling the emulsion to a second temperature of from 25° C. to 60° C.; maintaining the emulsion at the second temperature for at least 2 minutes; increasing the temperature of the emulsion to a third temperature of from 62° C. to 75° C.; and maintaining the emulsion at the third temperature for at least 2 minutes.

The emulsion comprises droplets of non-polymeric, crystalline, hydroxyl-containing structuring agent, preferably hydrogenated castor oil (HCO), in molten form. The droplets preferably have a mean diameter of from 0.1 microns to 4 microns, more preferably from 1 micron to 3.5 microns, even more preferably from 2 microns to 3.5 microns, most preferably from 2.5 microns to 3 microns. The mean diameter is measured at the temperature at which emulsification is completed.

The emulsion can be prepared by providing a first liquid comprising, or even consisting of, the non-polymeric, crystalline, hydroxyl-containing structuring agent in molten form and a second liquid comprising water. The first liquid is emulsified into the second liquid. This is typically done by combining the first liquid and second liquid together and passing them through a mixing device.

The second liquid preferably comprises from 50% to 99%, more preferably from 60% to 95%, most preferably from 70% to 90% by weight of water. The second liquid may also comprise a surfactant, in order to improve emulsification. In a preferred embodiment, at least 1% by weight of the second liquid, preferably 1% to 50%, more preferably 5% to 40%, most preferably 10 to 30% by weight of the second liquid comprises a surfactant. The surfactant can be selected from the group comprising anionic, cationic, non-ionic, zwitterionic surfactants, or mixtures thereof. Preferably, the surfactant is an anionic surfactant, more preferably alkylbenzene sulphonate, most preferably linear alkylbenzene sulfonate. It should be understood that the surfactant is present in the second liquid at a concentration such that the emulsion produced is droplets of non-polymeric, crystalline, hydroxyl-containing structuring agent, present in a primarily water continuous phase, not a primarily surfactant continuous phase.

The surfactant can be added either in the acid form or as a neutralized salt. The second liquid can comprise a neutralizing agent, particularly when the surfactant is added in the acid form. By 'neutralizing agent', we herein mean a substance used to neutralize an acidic solution, such as formed when the surfactant is added in its acid form. Preferably, the neutralizing agent is selected from the group consisting of: sodium hydroxide, $C_1$-$C_5$ ethanolamines, and mixtures thereof. A preferred neutralizing agent is a $C_1$-$C_5$ ethanolamine, more preferably monoethanolamine.

The second liquid can comprise a preservative. Preferably the preservative is an antimicrobial. Any suitable preservative can be used, such as one selected from the 'Acticide' series of antimicrobials, commercially available from Thor Chemicals, Cheshire, UK.

The first liquid and the second liquid are combined to form an emulsion at the first temperature. The first temperature is from 80° C. to 98° C., preferably from 85° C. to 95° C., more preferably from 87.5° C. to 92.5° C., to form the emulsion.

Preferably, the first liquid is at a temperature of 70° C. of higher, more preferably between 70° C. and 150° C. most preferably between 75° C. and 120° C., immediately before combining with the second liquid. This temperature range ensures that the non-polymeric, crystalline, hydroxyl-containing structuring agent is molten so that the emulsion is efficiently formed. However, a temperature that is too high results in discoloration or even degradation of the non-polymeric, crystalline, hydroxyl-containing structuring agent.

The second liquid is typically at a temperature of from 80° C. to 98° C., preferably from 85° C. to 95° C., more preferably from 87.5° C. to 92.5° C., before being combined with the first liquid. That is, at or close to, the first temperature.

The ratio of non-polymeric, crystalline, hydroxyl-containing structuring agent to water in the emulsion can be from 1:50 to 1:5, preferably 1:33 to 1:7.5, more preferably 1:20 to 1:10. In other words the ratio of non-polymeric, crystalline, hydroxyl-containing structuring agent to water, as the two liquid streams are combined, for instance, upon entering a mixing device, can be from 1:50 to 1:5, preferably 1:33 to 1:7.5, more preferably 1:20 to 1:10.

The process to make the emulsion can be a continuous process or a batch process. By being continuous, down-time between runs is reduced, resulting in a more cost and time efficient process. By 'continuous process' we herein mean continuous flow of the material through the apparatus. By 'batch processes' we herein mean where the process goes through discrete and different steps. The flow of product through the apparatus is interrupted as different stages of the transformation are completed, i.e. discontinuous flow of material.

Without being bound by theory, it is believed that the use of a continuous process provides improved control of the emulsion droplet size, as compared to a batch process. As a result, a continuous process typically results in more efficient production of droplets having the desired mean size, and hence a narrower range of droplet sizes. Batch production of the emulsion generally results in larger variation of the droplet size produced, due to the inherent variation in the degree of mixing occurring within the batch tank. Variability can arise due to the use and placement of the mixing paddle within the batch tank. The result is zones of slower moving liquid (and hence less mixing and larger droplets), and zones of faster moving liquid (and hence more mixing and smaller droplets). Those skilled in the art will know how to select appropriate mixing devices to enable a continuous process. Furthermore, a continuous process will allow for faster transfer of the emulsion to the cooling step. The continuous process will also allow for less premature cooling, that can occur in a batch tank before transfer to the cooling step.

The emulsion can be prepared using any suitable mixing device. The mixing device typically uses mechanical energy to mix the liquids. Suitable mixing devices can include static and dynamic mixer devices. Examples of dynamic mixer devices are homogenizers, rotor-stators, and high shear mixers. The mixing device could be a plurality of mixing devices arranged in series or parallel in order to provide the necessary energy dissipation rate.

In one embodiment, the emulsion is prepared by passing the first and second liquids through a microchannel mixing device. Microchannel mixing devices are a class of static mixers. Suitable microchannel mixing devices can be selected from the group consisting of: split and recombine mixing devices, staggered herringbone mixers, and mixtures thereof. In a preferred embodiment, the micro-channel mixing device is a split and recombine mixing device.

Preferably, the emulsion is formed by combining the ingredients via high energy dispersion, having an energy dissipation rate of from $1\times10^2$ W/Kg to $1\times10^7$ W/Kg, preferably from $1\times10^3$ W/Kg to $5\times10^6$ W/Kg, more preferably from $5\times10^4$ W/Kg to $1\times10^6$ W/Kg.

Without being bound by theory, it is believed that high energy dispersion reduces the emulsion size and increases the efficiency of the crystal growth in later steps.

In a second step the emulsion is cooled to a second temperature of from 25° C. to 60° C., preferably from 30° C. to 52° C., more preferably from 35° C. to 47° C. Without wishing to be bound by theory, it is believed that this cooling step increases the crystallinity of the non-polymeric, crystalline, hydroxyl-containing structuring agent. The emulsion is preferably cooled as quickly as possible. For instance, the emulsion can be cooled to the second temperature in a period of from 10 s to 15 minutes, preferably in a period of less than 5 minutes, more preferably less than 2 minutes.

The emulsion can be cooled to the second temperature by any suitable means, such as by passing it through a heat exchanger device. Suitable heat exchanger devices can be selected from the group consisting of: plate and frame heat exchanger, shell and tube heat exchangers, and combinations thereof.

The emulsion can be passed through more than one heat exchanger device. In this case the second and subsequent heat exchanger devices are typically arranged in series with respect to the first heat exchanger. Such an arrangement of heat exchanger devices can be used to control the cooling profile of the emulsion.

The emulsion is maintained at the second temperature for at least 2 minutes. Preferably, the emulsion is maintained at the second temperature for a period of from 2 to 30 minutes, preferably from 5 to 20 minutes, more preferably from 10 to 15 minutes.

In a subsequent step, the temperature of the emulsion is increased to a third temperature of from 62° C. to 75° C., preferably from 65° C. to 73° C., more preferably from 69° C. to 71° C. Without being bound by theory, it is believed that at this temperature, the emulsion droplets are able to elongate and grow, to form the longer threads of the aqueous structuring premix.

The temperature of the emulsion can be increased to the third temperature using any suitable means. Such means include one or more heat exchangers, heated piping, or transfer to a heated tank.

The emulsion is maintained at the third temperature for at least 2 minutes, in order for the threads to grow sufficiently to form the aqueous structuring premix of the present invention. Preferably, the emulsion is maintained at the third temperature for a period of from 2 to 30 minutes, preferably from 5 to 20 minutes, more preferably from 10 to 15 minutes.

The process of the present invention may comprise a further step of cooling the aqueous structuring premix to a fourth temperature of from 10° C. to 30° C., preferably from 15° C. to 24° C. In this temperature range, the threads are sufficiently stable to be stored for extended periods before use, and are also sufficiently robust such that the threads can be incorporated into liquid compositions without loss of the improved structuring.

The aqueous structuring premix can be cooled to the fourth temperature using any suitable means, including through the use of one or more heat exchangers.

The aqueous structuring premix formed from the process of the present invention comprises little or no spherulites of the non-polymeric, crystalline, hydroxyl-containing structuring agent. It is believed that such spherulites are highly inefficient at structuring, and providing viscosity. Since the process of the present invention produces little or no spherulites, it is believed that more non-polymeric, crystalline, hydroxyl-containing structuring agent is available for thread growth, and hence longer threads are formed.

Any suitable means can be used for incorporating the aqueous structuring premix into a liquid composition, including static mixers, and through the use of over-head mixers, such as typically used in batch processes.

Preferably, the aqueous structuring premix is added after the incorporation of ingredients that require high shear mixing, in order to minimise damage to the threads of the aqueous structuring premix. More preferably, the aqueous structuring premix is the last ingredient incorporated into the liquid composition. The aqueous structuring premix is preferably incorporated into the liquid composition using low shear mixing. Preferably, the aqueous structuring premix is incorporated into the liquid composition using average shear rates of less than 1000 $s^{-1}$, preferably less than 500 $s^{-1}$, more preferably less than 200 $s^{-1}$. The residence time of mixing is preferably less than 20 s, more preferably less than 5 s, more preferably less than 1 s. The shear rate and residence time is calculated according to the methods used for the mixing device, and is usually provided by the manufacturer. For instance, for a static mixer, the average shear rate is calculated using the equation:

$$\dot{\gamma} = \frac{v_{pipe}}{D_{pipe}} * v_f^{-3/2}$$

where:

$v_f$ is the void fraction of the static mixer (provided by the supplier)

$D_{pipe}$ is the internal diameter of the pipe comprising the static mixer elements $v_{pipe}$ is the average velocity of the fluid through a pipe having internal diameter $D_{pipe}$, calculated from the equation:

$$v_{pipe} = \frac{4Q}{\pi D_{pipe}^2}$$

Q is the volume flow rate of the fluid through the static mixer.

For a static mixer, the residence time is calculated using the equation:

$$\text{residence time} = \frac{\pi D_{pipe}^2 v_f L}{4Q}$$

where:

L is the length of the static mixer.

Methods:

A) pH Measurement:

The pH is measured on the neat composition, at 25° C., using a Santarius PT-10P pH meter with gel-filled probe (such as the Toledo probe, part number 52 000 100), calibrated according to the instructions manual.

B) Rheology:

An AR-G2 rheometer from TA Instruments is used for rheological measurements, with a 40 mm standard steel parallel plate, 300 μm gap. All measurements, unless otherwise stated, are conducted according to the instruction manual, at steady state shear rate, at 25° C.

C) Method of Measuring Thread Size:

The aqueous structuring premix was analysed using Atomic force microscopy (AFM). The sample was prepared using the following procedure: The single side polished Si wafer (<100>, 381 micron thickness, 2 nm native oxide, sourced from IDB Technologies, UK) is first cracked or cut into a piece of approximate dimensions 20×20 mm. The aqueous structuring premix is applied liberally to the Si wafer, using a cotton bud (Johnson & Johnson, UK). The paste-coated wafer is placed into a lidded poly(styrene) Petri dish (40 mm diameter, 10 mm height, Fisher Scientific, UK) and left for 5 minutes in air under ambient conditions (18° C., 40-50% RH). The Petri dish is then filled with $H_2O$ (HPLC grade, Sigma-Aldrich, UK) and the sample is left in the immersed conditions for approximately 1 hour. Following this, a cotton bud is used to remove the paste which has floated up away from the Si wafer surface, whilst the Si wafer was still immersed under HPLC grade $H_2O$. The Si wafer is then removed from the Petri dish and rinsed with HPLC grade $H_2O$. Subsequently, the Si wafer is dried in a fan oven at 35° C. for 10 min. The wafer surface is then imaged as follows: The Si wafer is mounted in an AFM (NanoWizard II, JPK Instruments) and imaged in air under ambient conditions (18° C., 40-50% RH) using a rectangular Si cantilever with pyramidal tip (PPP-NCL, Windsor Scientific, UK) in Intermittent Contact Mode. The image dimensions are 20 micron by 20 micron, the pixel density is set to 1024×1024, and the scan rate is set to 0.3 Hz, which corresponded to a tip velocity of 12 micron/s.

The resultant AFM image is analysed as follows: The AFM image is opened using ImageJ, version 1.46 (National Institute of Health, downloadable from: http://rsb.info.nih-.gov/ij/). In the "Analyze" menu, the scale is set to the actual image size in microns, 20 μm by 20 μm. 20 threads, which do not contact the image edge, are selected at random. Using the "freehand line" function from the ImageJ Tools menu, the selected threads are each traced, and the length is measured (menu selections: "Plugins"/"Analyze"/"Measure and Set Label"/"Length").

Three sets of measurements (sample preparation, AFM measurement and image analysis) are made, the results averaged.

D) Energy Dissipation Rate:

In a continuous process comprising a static emulsification device, the energy dissipation rate is calculated by measuring the pressure drop over the emulsification device, and multiplying this value by the flow rate, and then dividing by the active volume of the device. In the case where an emulsification is conducted via an external power source, such as a batch tank or high shear mixer, the energy dissipation is calculated via the following Formula 1 (Kowalski, A. J., 2009. Power consumption of in-line rotor-stator devices. Chem. Eng. Proc. 48, 581);

$$P_f = P_T + P_F + P_L \qquad \text{Formula 1}$$

Wherein $P_T$ is the power required to rotate the rotor against the liquid, $P_F$ is the additional power requirements from the flow of liquid and $P_L$ is the power lost, for example from bearings, vibration, noise etc.

E) Rheology Measurement:

Unless otherwise specified, the viscosity is measured using an Anton Paar MCR 302 rheometer (Anton Paar, Graz, Austria), with a cone and plate geometry having an angle of 2°, and a gap of 206 microns. The shear rate is held constant at a shear rate of 0.01 $s^{-1}$, until steady state is achieved, then the viscosity is measured. The shear rate is then measured at 0.0224 $s^{-1}$, 0.05 $s^{-1}$, 0.11 $s^{-1}$, 0.25 $s^{-1}$, 0.55 $s^{-1}$, 0.255 $s^{-1}$, 2.8 $s^{-1}$, 6.25 $s^{-1}$, 14 $s^{-1}$, 31.2 $s^{-1}$, 70 $s^{-1}$, waiting 10 seconds at each shear rate before each measurement is taken. All measurements were done on 20° C.

Examples

Aqueous structuring premix A, of the present invention, was prepared in a continuous process, using the following procedure:

Hydrogenated castor oil was melted to form a first liquid at 90+/−5° C. A second liquid, comprising 6.7 wt % linear alkylbenzene sulphonic acid (HLAS) and 3.34 wt % monoethanolamine, in water, was prepared at 90+/−5° C. The first liquid was emulsified into the second liquid at a ratio of 4:96, via a continuous process, by combining the liquids and passing through a split-and-recombine static mixer, consisting of 11 steps and an inner diameter of 0.6 mm (Ehrfeld, Wendelsheim, Germany) at a flow rate of 10 Kg/hr, to form an emulsion at 86° C. The resultant average emulsion size was 2.88 microns.

1 Kg/hr of the fluid was diverted to a heat exchanger, which comprised 3 m of coiled ⅛" stainless steel tubing, followed by 2 m of coiled ¼" stainless steel tubing suspending in a water bath, which was used to cool and maintain the emulsion at a temperature of 41° C. The fluid was then passed through a second heat exchanger, which comprised 6 m of coiled ⅛" stainless steel tubing, followed by 4.6 m of coiled ⅜" stainless steel tubing suspending in a water bath, which was used to heat up and maintain the fluid at a temperature of 71° C., in order to grow the long threads. The premix was then cooled to a temperature of 20° C., and stored.

Comparative aqueous structuring premix B was prepared in a batch process, using the following procedure:

A liquid, comprising 6.7 wt % linear alkylbenzene sulphonic acid (HLAS) and 3.34 wt % monoethanolamine, in water, was prepared at 90+/−5° C. Particulated hydrogenated castor oil was slowly dispersed into the liquid at a ratio of 4:96, in a batch process under agitation. Once molten, the hydrogenated castor oil is emulsified into the liquid. The emulsion was then slowly cooled at a rate 1° C./min, until a temperature of 40° C. was reached. The aqueous structuring premix was then transferred to a storage tank and allowed to cool to room temperature.

The resultant aqueous structuring premixes: premix A of the invention, and comparative premix B, both had the following composition:

| | wt % |
|---|---|
| Monoethanolamine | 3.2 |
| Linear alkylbenzene sulphonic acid (HLAS) | 16.0 |
| Hydrogenated castor oil (HCO) | 4.0 |
| Water | 76.8 |

However, because of the different making processes, premix A, of the invention, comprised a greater proportion of longer threads:

| Thread length (microns) | Aqueous premix A % threads | Aqueous premix B (comparative) % threads |
|---|---|---|
| <2 | 15.000 | 57.50 |
| 2-4 | 16.667 | 7.50 |
| 4-6 | 13.333 | 7.50 |
| 6-8 | 6.667 | 10.00 |
| 8-10 | 8.333 | 5.00 |
| 10-12 | 5.000 | 5.00 |
| 12-14 | 10.000 | 0.00 |
| 14-16 | 8.333 | 0.00 |
| 16-18 | 5.000 | 2.50 |
| 18-20 | 3.333 | 0.00 |
| >20 | 8.333 | 5.00 |

Liquid compositions, having the following composition, and comprising either aqueous structuring premix A of the invention, or comparative aqueous structuring premix B, were prepared:

| | Liquid composition A wt % | Liquid composition B (Comparative) wt % |
|---|---|---|
| Monoethanolamine | 2.25 | 2.25 |
| Linear alkylbenzene sulphonic acid (HLAS) | 11.25 | 11.25 |
| Water | 80.25 | 80.25 |
| Aqueous structuring premix A (of the invention) | 6.25 | — |
| Aqueous structuring premix B (comparative) | — | 6.25 |

Both liquid compositions, A and B, were prepared using the following procedure:

The monoethanolamine and linear alkylbenzene sulphonic acid (HLAS) were blended into the water at the correct ratio. 937.5 ml of the blend was added to a 1 L beaker, and a mixer propeller, connected to an overhead mixer, was inserted into the blend, such that the propeller head was at a depth equivalent to the 250 ml mark on the beaker.

The tip of a 7 ml plastic Pasteur pipette was removed at the 1 ml mark, and the pipette end was also removed to obtain an opening of diameter 5 ml. The modified pipette tip was then fastened over the end of a 50 ml plastic syringe. The syringe was then filled with the aqueous structuring premix. Sufficient syringes were prepared, in order to add 62.5 ml of the aqueous structuring premix to the beaker.

The overhead mixer was then switched on, and the speed increased until the resultant vortex was close to the propeller, but sufficiently high above the propeller that no air was entrained into the vortex. 62.5 ml of the aqueous structuring premix was then added over 75 seconds, and stirring continued for an additional 15 seconds to adequately incorporate the aqueous structuring premix into the treatment composition.

The resultant low shear viscosities (measured at 0.01 $s^{-1}$), for treatment composition A, comprising the aqueous structuring premix of the present invention, and treatment composition B, comprising the comparative aqueous structuring premix, are given below:

| | Low shear viscosity (at 0.01 $s^{-1}$) |
|---|---|
| Liquid composition A, comprising premix A (of the invention) | 61.66 |
| Liquid composition B, comprising premix B (comparative) | 46.53 |

The following are non-limiting examples of aqueous structuring premixes of the present invention, which can be made using the process described herein:

| Ingredient | Aqueous structuring premix C wt % | Aqueous structuring premix D wt % | Aqueous structuring premix E wt % | Aqueous structuring premix F wt % | Aqueous structuring premix G wt % |
|---|---|---|---|---|---|
| Softened water | 73.55 | 75.1 | 73.6 | 74.6 | 75.6 |
| Monoethanolamine | 3.2 | 3.2 | 3.2 | 3.2 | 3.2 |
| Linear alkylbenzene sulphonic acid (HLAS) (<20% 2-phenyl isomers) | 16 | — | — | 16 | 16 |
| Linear alkylbenzene sulphonic acid (HLAS) (>20% 2-phenyl isomers) | — | 16 | 16 | — | — |
| Hydrogenated Castor Oil (HCO) | 6 | 4 | 5 | 4 | 4 |
| 1,2 propanediol | 1.05 | — | 2 | 2 | — |
| Urea | — | — | — | — | 1 |
| Acticide | 0.2 | 0.2 | 0.2 | 0.2 | 0.2 |

The aqueous structuring premixes, according to the invention, can be added to unstructured treatment compositions, to form structured treatment compositions, as described below:

| Ingredient | Liquid composition C wt % | Liquid composition D wt % |
|---|---|---|
| Linear Alkylbenzene sulphonic acid[1] | 7.5 | 10.5 |
| C12-14 alkyl ethoxy 3 sulphate Na salt | 2.6 | — |
| C12-14 alkyl ethoxy 3 sulphate MEA salt | — | 8.5 |
| C12-14 alkyl 7-ethoxylate | 0.4 | 7.6 |
| C14-15 alkyl 7-ethoxylate | 4.4 | — |
| C12-18 Fatty acid | 3.1 | 8 |
| Sodium Cumene sulphonate | 0.9 | — |
| Citric acid | 3.2 | 2.8 |
| Ethoxysulfated Hexamethylene Diamine Dimethyl Quat | 1 | 2.1 |
| Soil Suspending Alkoxylated Polyalkylenimine Polymer[2] | 0.4 | |
| PEG-PVAc Polymer[3] | 0.5 | 0.8 |
| Di Ethylene Triamine Penta (Methylene Phosphonic acid, Na salt) | 0.3 | — |
| Hydroxyethane diphosphonic acid | — | 1.5 |
| Fluorescent Whitening Agent | 0.1 | 0.3 |
| 1,2 Propanediol | 3.9 | 7.5 |
| Diethylene Glycol | — | 3.5 |
| Sodium Formate | 0.4 | 0.4 |
| Hydrogenated castor oil (HCO) [4] | 0.38 | 0.75 |
| Perfume | 0.9 | 1.7 |
| Sodium Hydroxide | To pH 8.4 | — |
| Monoethanolamine | 0.3 | To pH 8.1 |
| Protease enzyme | 0.4 | 0.7 |
| Amylase enzyme | — | 0.7 |
| Mannanase enzyme | 0.1 | 0.2 |
| Xyloglucanase enzyme | — | 0.1 |
| Pectate lyase | 0.1 | — |
| Water and minors (antifoam, aesthetics, . . . ) | To 100 parts | |

[1]Weight percentage of Linear Alkylbenzene sulfonic acid includes that which added to the composition via the premix

[2]600 g/mol molecular weight polyethylenimine core with 20 ethoxylate groups per —NH.

[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[4] From an aqueous structuring premix according to the invention.

Alternatively, the aqueous structuring premixes, according to the invention, can be added to low water unstructured treatment compositions, to form structured low water treatment compositions, as described below:

| Ingredient | Liquid composition E wt % | Liquid composition F wt % | Liquid composition G wt % |
|---|---|---|---|
| Linear Alkylbenzene sulphonic acid[1] | 15 | 17 | 19 |
| C12-14 alkyl ethoxy 3 sulphonic acid | 7 | 8 | — |
| C12-15 alkyl ethoxy 2 sulphonic acid | — | — | 9 |
| C14-15 alkyl 7-ethoxylate | — | 14 | — |
| C12-14 alkyl 7-ethoxylate | 12 | — | — |
| C12-14 alkyl-9-ethoxylate | — | — | 15 |
| C12-18 Fatty acid | 15 | 17 | 5 |
| Citric acid | 0.7 | 0.5 | 0.8 |
| Polydimethylsilicone | — | 3 | — |
| Soil Suspending Alkoxylated Polyalkylenimine Polymer[2] | 4 | — | 7 |
| Hydroxyethane diphosphonic acid | 1.2 | — | — |
| Diethylenetriamine Pentaacetic acid | — | — | 0.6 |
| Ethylenediaminediscuccinic acid | — | — | 0.6 |
| Fluorescent Whitening Agent | 0.2 | 0.4 | 0.2 |
| 1,2 Propanediol | 16 | 12 | 14 |
| Glycerol | 6 | 8 | 5 |
| Diethyleneglycol | — | — | 2 |
| Hydrogenated castor oil (HCO) [4] | 0.15 | 0.25 | 0.1 |
| Perfume | 2.0 | 1.5 | 1.7 |
| Perfume microcapsule | — | 0.5 | — |
| Monoethanolamine | Up to pH 8 | Up to pH 8 | Up to pH 8 |
| Protease enzyme | 0.05 | 0.075 | 0.12 |
| Amylase enzyme | 0.005 | — | 0.01 |
| Mannanase enzyme | 0.01 | — | 0.005 |
| xyloglucanase | — | — | 0.005 |
| Water and minors (antifoam, aesthetics, stabilizers etc.) | To 100 parts | To 100 parts | To 100 parts |

The resultant low water treatment compositions can be encapsulated in water-soluble film, to form water-soluble unit-dose articles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous structuring premix comprising water and a non-polymeric, crystalline, hydroxyl-containing structuring agent in the form of threads, wherein at least 25% by number of the threads have a length greater than 10 microns when the structuring premix is at a temperature of from about 10° C. to about 30° C., wherein the structuring premix is made according to a process comprising the following steps:

a) melting the non-polymeric, crystalline, hydroxyl-containing structuring agent to form a first liquid;

b) making an emulsion comprising the first liquid and a second liquid comprising an anionic surfactant and water, at a first temperature of from 80° C. to about 98° C.;

c) cooling the emulsion to a second temperature of from about 25° C. to about 60° C.;

d) maintaining the emulsion at the second temperature for at least about 2 minutes;

e) increasing the temperature of the emulsion to a third temperature of from about 62° C. to 75° C.;

f) maintaining the emulsion at the third temperature for at least about 2 minutes;

g) cooling the emulsion to a fourth temperature of from about 10° C. to about 30° C. to form the aqueous structuring premix; and wherein the non-polymeric, crystalline, hydroxyl-containing structuring agent comprises hydrogenated castor oil.

2. The structuring premix according to claim 1, wherein at least about 35% by number of the threads have a length greater than 10 microns.

3. The structuring premix according to claim 1, wherein at least about 10% by number of the threads have a length greater than about 14 microns.

4. The structuring premix according to claim 3, wherein at least about 15% by number of the threads have a length greater than about 14 microns.

5. The structuring premix according to claim 4, wherein at least about 20% by number of the threads have a length greater than about 14 microns.

6. The structuring premix according to claim 1, wherein the non-polymeric, crystalline, hydroxyl-containing structuring agent consists of hydrogenated castor oil.

7. A liquid composition comprising the aqueous structuring premix according to claim 1.

8. The liquid composition according to claim 7, wherein the liquid composition is a liquid detergent composition, comprising at least one surfactant, present at a level of from about 1 to about 70% by weight of the liquid composition.

9. The liquid composition according to claim 7, wherein the liquid composition further comprises particulates or droplets.

10. The structuring premix of claim 1, wherein in step (d) of the process of making the premix, the emulsion is maintained at the second temperature for a period of up to about 30 minutes.

11. The structuring premix of claim 10, wherein in step (d) of the process of making the premix, the emulsion is maintained at the second temperature for a period from about 5 to about 20 minutes.

12. The structuring premix of claim 1, wherein in step (b) of the process of making the premix, the emulsion is formed by combining the ingredients via high energy dispersion, having an energy dissipation rate of from about $1\times10^2$ W/Kg to about $1\times10^7$ W/Kg.

13. The structuring premix of claim 12, wherein in step (b) of the process of making the premix, the emulsion is formed by combining the ingredients via high energy dispersion, having an energy dissipation rate of from about $1\times10^3$ W/Kg to about $5\times10^6$ W/Kg.

14. The structuring premix of claim 1, wherein the process is continuous.

15. An aqueous structuring premix comprising water and a non-polymeric, crystalline, hydroxyl-containing structuring agent in the form of threads, wherein at least 10% by number of the threads have a length greater than 14 microns when the structuring premix is at a temperature of from about 10° C. to about 30° C.; wherein the structuring premix is made according to a process comprising the following steps:

a) melting the non-polymeric, crystalline, hydroxyl-containing structuring agent to form a first liquid;

b) making an emulsion comprising the first liquid and a second liquid comprising an anionic surfactant and water, at a first temperature of from 80° C. to about 98° C.;

c) cooling the emulsion to a second temperature of from about 25° C. to about 60° C.;

d) maintaining the emulsion at the second temperature for at least about 2 minutes;

e) increasing the temperature of the emulsion to a third temperature of from about 62° C. to 75° C.;

f) maintaining the emulsion at the third temperature for at least about 2 minutes;

g) cooling the emulsion to a fourth temperature of from about 10° C. to about 30° C. to form the aqueous structuring premix; and wherein the non-polymeric, crystalline, hydroxyl-containing structuring agent comprises hydrogenated castor oil.

16. The structuring premix according to claim 15, wherein at least about 15% by number of the threads have a length greater than about 10 microns.

17. The structuring premix according to claim 15, wherein at least about 25% by number of the threads have a length greater than about 10 microns.

18. The structuring premix according to claim 15, wherein at least about 15% by number of the threads have a length greater than about 14 microns.

19. The structuring premix according to claim 18, wherein at least about 20% by number of the threads have a length greater than about 14 microns.

20. The structuring premix according to claim 15, wherein the non-polymeric, crystalline, hydroxyl-containing structuring agent consists of hydrogenated castor oil.

* * * * *